US007827895B2

(12) United States Patent
Wang

(10) Patent No.: US 7,827,895 B2
(45) Date of Patent: Nov. 9, 2010

(54) SAFETY ELASTIC ROPE

(76) Inventor: Wen-Ching Wang, No. 168, Lane 14, 6 Rd., Nan-Yang Rd., Sha-Lu Chen, Taichung Hsien (TW)

( * ) Notice: Subject to any disclaimer, the term of this patent is extended or adjusted under 35 U.S.C. 154(b) by 125 days.

(21) Appl. No.: 12/271,150

(22) Filed: Nov. 14, 2008

(65) Prior Publication Data

US 2010/0122625 A1 May 20, 2010

(51) Int. Cl.
*D04C 1/06* (2006.01)

(52) U.S. Cl. ..... 87/6; 87/9; 57/225

(58) Field of Classification Search ..... 87/6, 87/9; 57/225; 482/49, 121, 122, 126, 128
See application file for complete search history.

(56) References Cited

U.S. PATENT DOCUMENTS 2,089,379 A * 8/1937 Johnson ..... 87/2
2,887,005 A * 5/1959 Fromm ..... 87/1
4,258,608 A * 3/1981 Brown ..... 87/6
4,563,869 A * 1/1986 Stanton ..... 57/211
4,640,178 A * 2/1987 Kurzbock ..... 87/6
4,777,784 A * 10/1988 Ferguson ..... 54/34
4,784,386 A * 11/1988 Muehl ..... 482/122
5,800,322 A * 9/1998 Block ..... 482/126
6,341,550 B1 * 1/2002 White ..... 87/5
6,575,072 B2 * 6/2003 Pellerin ..... 87/6
2007/0155600 A1 * 7/2007 Cunningham et al. ..... 482/126
2007/0207905 A1 * 9/2007 Winston ..... 482/126

* cited by examiner

*Primary Examiner*—Shaun R Hurley
(74) *Attorney, Agent, or Firm*—Banner & Witcoff, Ltd.

(57) ABSTRACT

A safety elastic rope includes an elastic outer tubular rope having two longitudinally opposite first fixing ends, and an elastic inner rope inserted into the outer tubular rope and having two longitudinally opposite second fixing ends. The inner rope is more elastic than the outer tubular rope, and has substantially the same length as the outer tubular rope. The second fixing ends are connected respectively to the first fixing ends.

12 Claims, 15 Drawing Sheets

SAFETY ELASTIC ROPE

BACKGROUND OF THE INVENTION

1. Field of the Invention

This invention relates to a rope, more particularly to a safety elastic rope which has an elastic outer tubular rope and an inner rope.

2. Description of the Related Art

A conventional elastic rope 11 is commonly used to form an exercising device 1 (see FIG. 1) for performing various exercises. In some instances, the elastic rope 11 is connected to a stationary exercise machine (not shown). Since the elastic rope 11 is made of a rubber-based material, such as natural rubber, thermoplastic rubber (TPR), etc., it oxidizes easily, and thus breaks easily. Particularly, when the exercising device 1 is stored, the elastic rope 11 is usually rolled up, so that oxidation easily occurs in bending portions of the elastic rope 11. When the elastic rope 11 is removed from storage and used, it may break and, in some cases, inflict injury on the user.

To overcome the aforementioned drawback, referring back to FIG. 1, a nylon woven sleeve 12 is sleeved on an outer portion of the conventional elastic rope 11. When the elastic rope 11 breaks, it is constrained within the nylon woven sleeve 12, and is not likely to be directed toward the user and inflict injury. Since the nylon woven sleeve 12 is not elastic, the length of the nylon woven sleeve 12 must be longer than that of the elastic rope 11, so that the elastic rope 11 can be stretched and used effectively. However, prior to stretching of the elastic rope 11, the nylon woven sleeve 12 is collected on the outer portion of the elastic rope 11 and forms an irregular crease. This adversely affects the appearance of the elastic rope 11. Further, the conventional elastic rope 11 with the nylon woven sleeve 12 sleeved thereon is not suitable for use in other exercising devices.

Moreover, the length of the elastic rope 11 when stretched is generally about eight to ten times its original unstretched length. If such a length of the nylon woven sleeve 12 is to be used, i.e., eight to ten times the original length of the elastic rope 11, the accumulation of the nylon woven sleeve 12 on the outer portion of the elastic rope 11 will be substantial when the elastic rope 11 is long. Hence, in order to reduce the amount of accumulation and the material cost of the nylon woven sleeve 12, and to allow the elastic rope 11 to be suitable for used on various exercising devices, a length of the nylon woven sleeve 12 that is about four times the original length of the elastic rope 11 is frequently used. In this case, when the elastic rope 11 is stretched to a length greater than that of the nylon woven sleeve 12, the nylon woven sleeve 12 may break or tear and may therefore lose its protection capability.

SUMMARY OF THE INVENTION

Therefore, the object of the present invention is to provide a safety elastic rope that is safe to use, that has an enhanced appearance, and that is suitable for use in various applications.

According to this invention, a safety elastic rope comprises an elastic outer tubular rope having two longitudinally opposite first fixing ends, and an elastic inner rope inserted into the outer tubular rope and having two longitudinally opposite second fixing ends. The inner rope is more elastic than the outer tubular rope, and has substantially the same length as the outer tubular rope. The second fixing ends are connected respectively to the first fixing ends.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
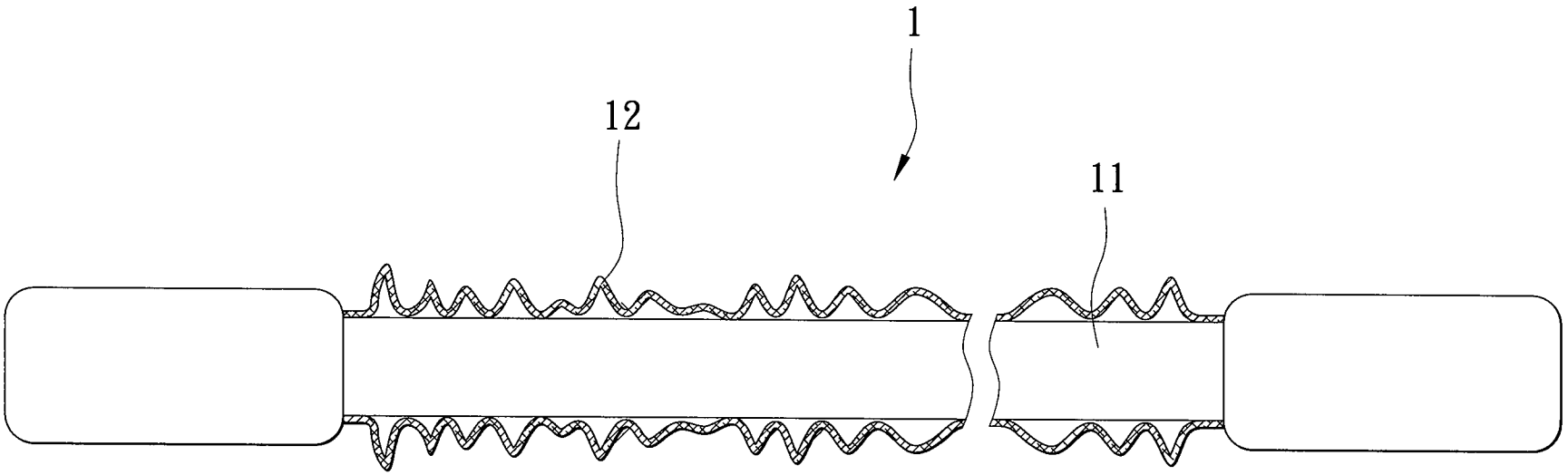
FIG. 1 PRIOR ART
FIG. 1 is a fragmentary sectional view of a conventional elastic rope.

Before the present invention is described in greater detail, it should be noted that the same reference numerals have been used to denote like elements throughout the specification.

Figure 2:
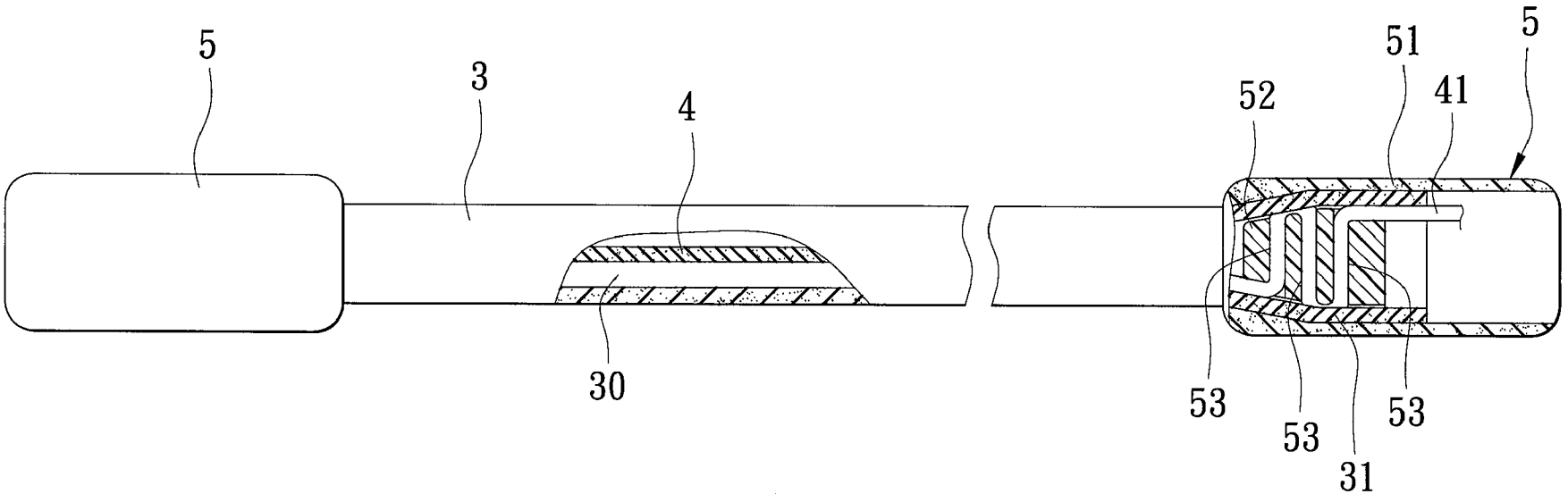
FIG. 2 is a fragmentary partly sectional view of a safety elastic rope according to the first preferred embodiment of the present invention.

Referring to FIG. 2, a safety elastic rope according to the first preferred embodiment of the present invention is shown to comprise an elastic outer tubular rope 3, an elastic inner rope 4, and two fixing members 5.

The elastic outer tubular rope 3 has two longitudinally opposite first fixing ends 31, and a longitudinal through passage 30 extending through the first fixing ends 31.

The inner rope 4 in this embodiment is made of a material selected from the group consisting of natural rubber, thermoplastic elastomer (TPE) such as styrene ethylene butadiene styrene (SEBS) and thermoplastic polyurethane (TPU), and thermoplastic rubber (TPR). The inner rope 4 is inserted into the through passage 30, and has two longitudinally opposite second fixing ends 41 connected respectively to the first fixing ends 31.

Each of the fixing members 5 includes a sleeve portion 51, and a core portion 52 surrounded by the sleeve portion 51 and having a plurality of fixing holes 53 that are transverse to a longitudinal direction of the outer tubular rope 3. One of the first fixing ends 31 is inserted into the sleeve portion 51. The core portion 52 has a cross section larger than that of the through passage 30, and squeezes into and stretches transversely one of the first fixing ends 31. As a result, one of the first fixing ends 31 is pressed between an inner surface of the sleeve portion 51 and an outer surface of the core portion 52. One of the second fixing ends 41 extends fittingly through and turns between the fixing holes 53.

Since the inner rope 4 is not exposed, it does not easily oxidize and break. Preferably, the inner rope 4 is more elastic than the outer tubular rope 3, and has substantially the same length as the outer tubular rope 3. Further, because the outer tubular rope 3 is provided with the inner rope 4 extending therethrough, the outer tubular rope 3 tends not to bend fully, so that oxidation at bending portions of the outer tubular rope 3 is minimized, and the strength of the safety elastic rope of the present invention is maintained.

Since the inner rope 4 is more elastic than the outer tubular rope 3, it is more stretchable than the outer tubular rope 3. Therefore, when the safety elastic rope of the present invention is stretched excessively by a user, the outer tubular rope 3 can break first. As the inner rope 4 does not break when the outer tubular rope 3 initially breaks, the outer tubular rope 3 can be prevented by the inner rope 4 from being quickly directed toward and hurting the user.

Figure 3:
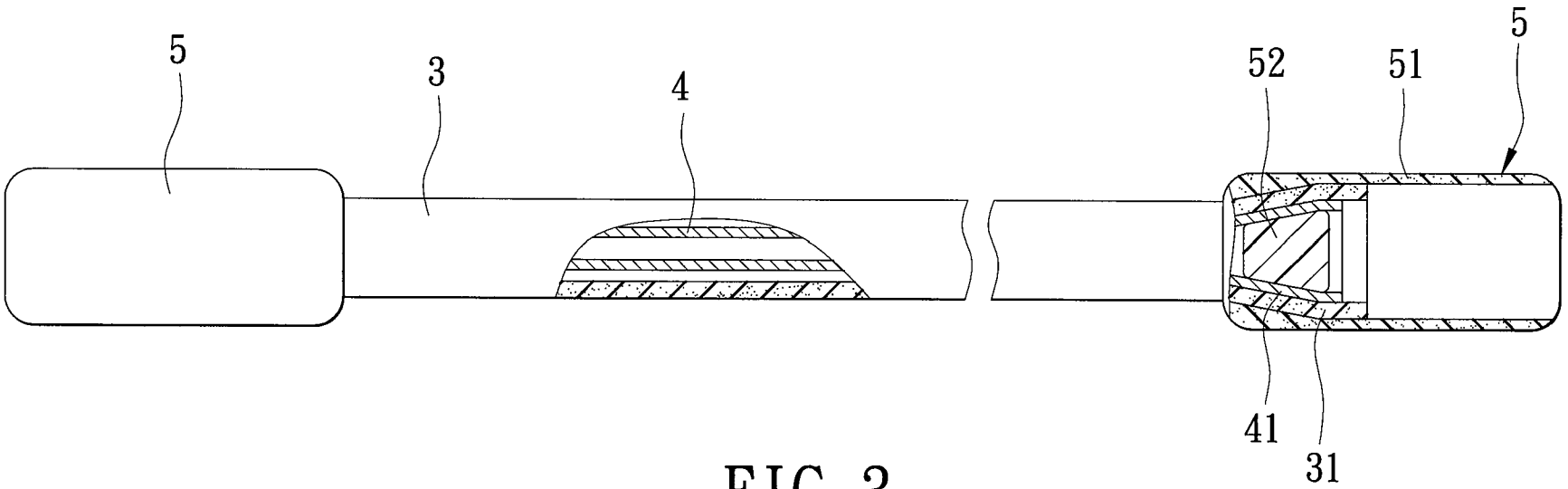
FIG. 3 is a view similar to FIG. 2, but illustrating an alternative form of an inner rope of the first preferred embodiment.

Alternatively, the inner rope 4 may be tubular, as shown in FIG. 3. In this case, the core portion 52 of each fixing member 5 further squeezes into one of the second fixing ends 41, so that one of the second fixing ends 41 is pressed between the core portion 52 and one of the first fixing ends 31.

Figure 4:
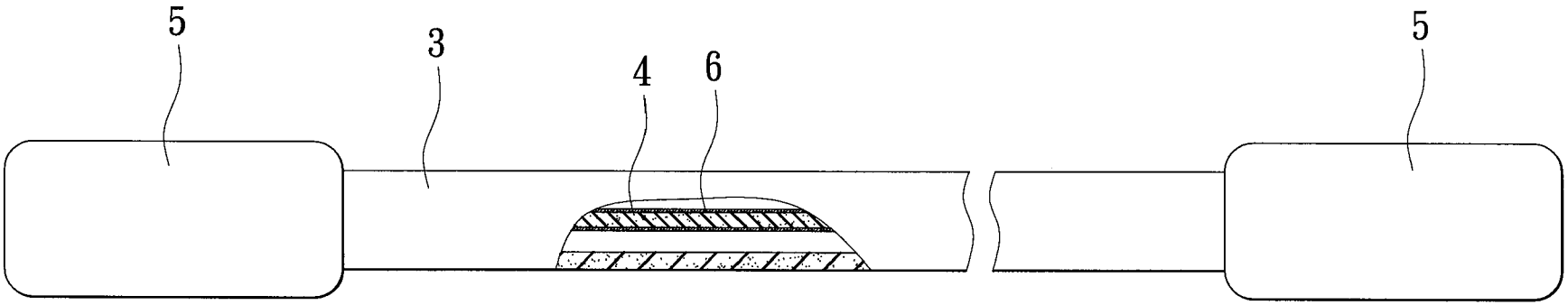
FIG. 4 is a fragmentary partly sectional view of a safety elastic rope according to the second preferred embodiment of the present invention.

Referring to FIG. 4, a safety elastic rope according to the second preferred embodiment of the present invention is shown to be similar to the first preferred embodiment. However, in this embodiment, the safety elastic rope further comprises an elastic woven net 6 covering the inner rope 4 and having two opposite ends fixed respectively to the second fixing ends 41 (see FIG. 2).

Figure 5:
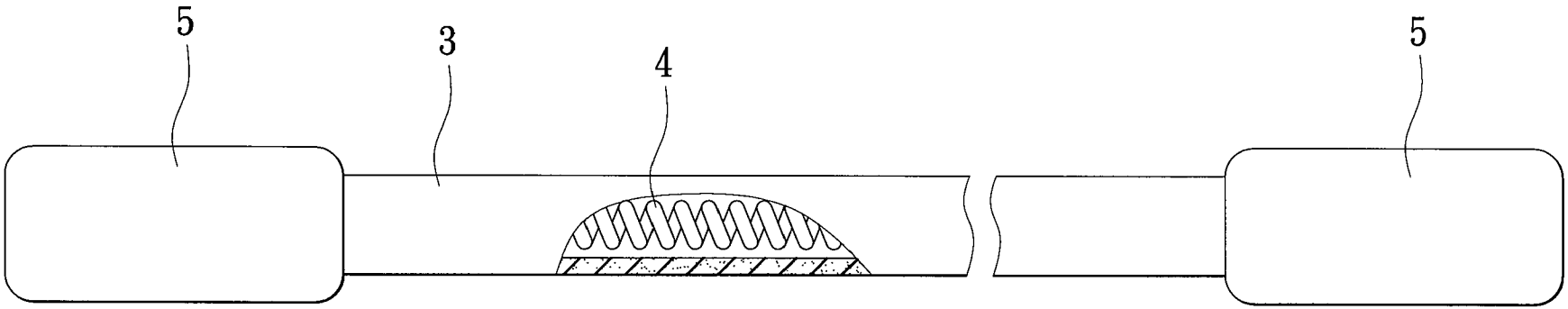
FIG. 5 is a fragmentary partly sectional view of a safety elastic rope according to the third preferred embodiment of the present invention.

Referring to FIG. 5, a safety elastic rope according to the third preferred embodiment of the present invention is shown to be similar to the first preferred embodiment. However, in this embodiment, the inner rope 4 extends helically, and is made of a material selected from the group consisting of polypropylene (PP), polyethylene (PE), nylon, and polyvinyl chloride (PVC).

Figure 6:
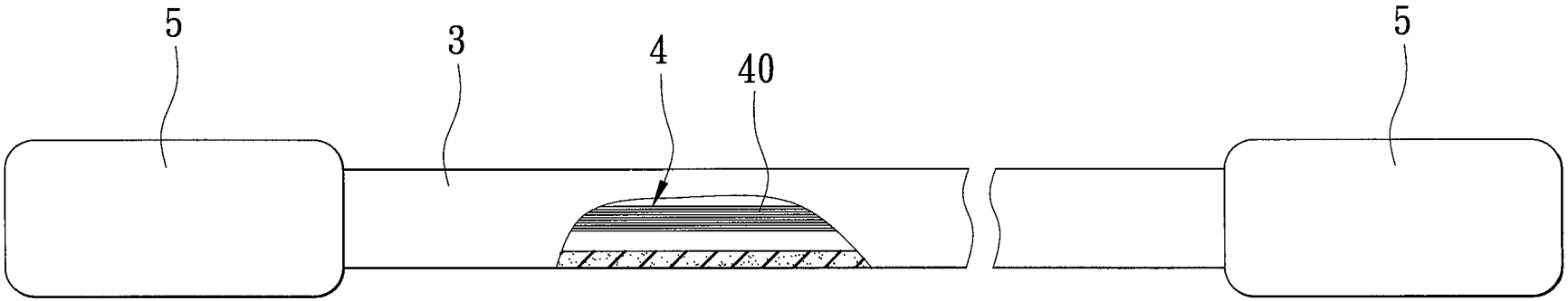
FIG. 6 is a fragmentary partly sectional view of a safety elastic rope according to the fourth preferred embodiment of the present invention.

Referring to FIG. 6, a safety elastic rope according to the fourth preferred embodiment of the present invention is shown to be similar to the first preferred embodiment. However, in this embodiment, the inner rope 4 includes a plurality of fine elastic strings 40 that are parallel to each other. In some embodiments, each of the fine elastic strings 40 is covered by an elastic woven net (not shown).

Figure 7:
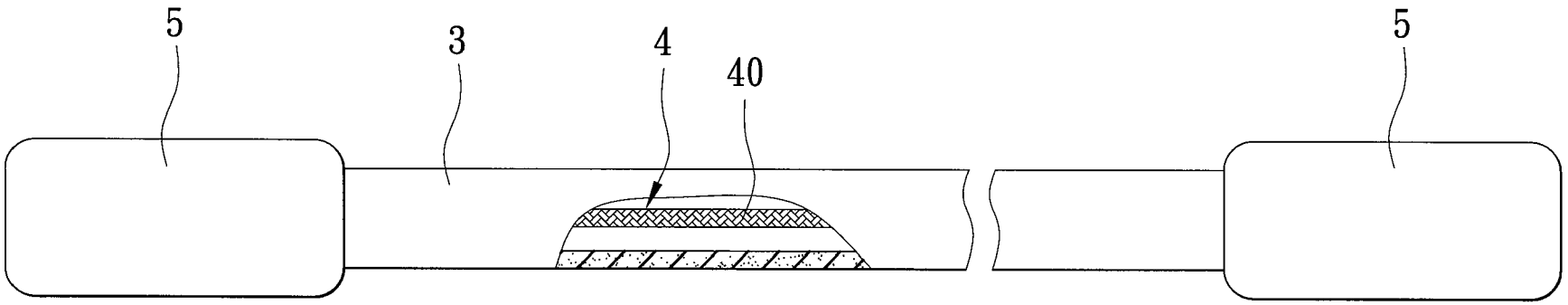
FIG. 7 is a view similar to FIG. 6, but illustrating an alternative form of an inner rope of the fourth preferred embodiment.

Alternatively, as shown in FIG. 7, the fine elastic strings 40 may be interlaced and covered by an elastic woven net rope (not shown).

Figure 8:
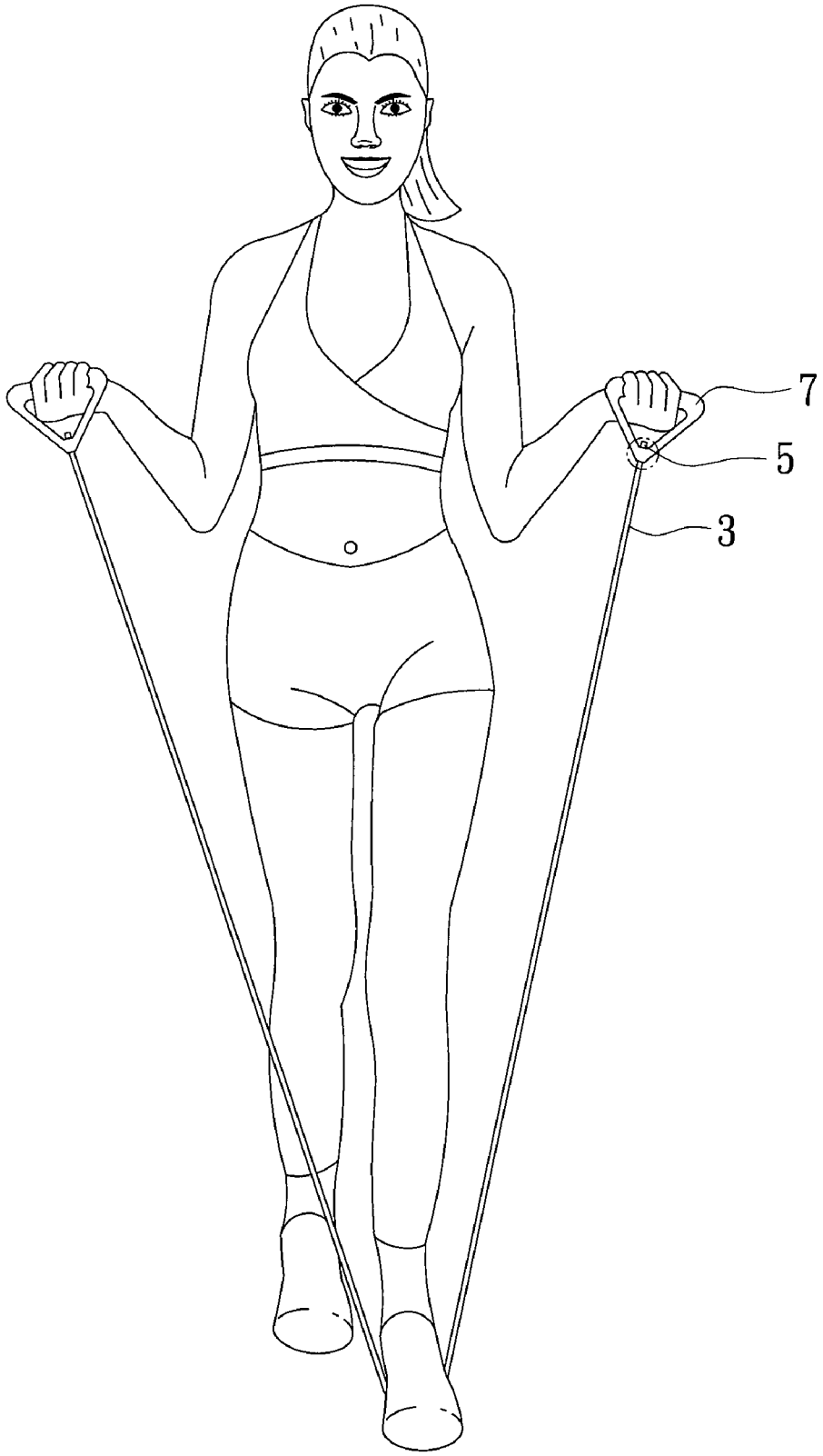
FIG. 8 is a schematic view of a safety elastic rope according to the fifth preferred embodiment of the present invention in a state of use.
Figure 9:
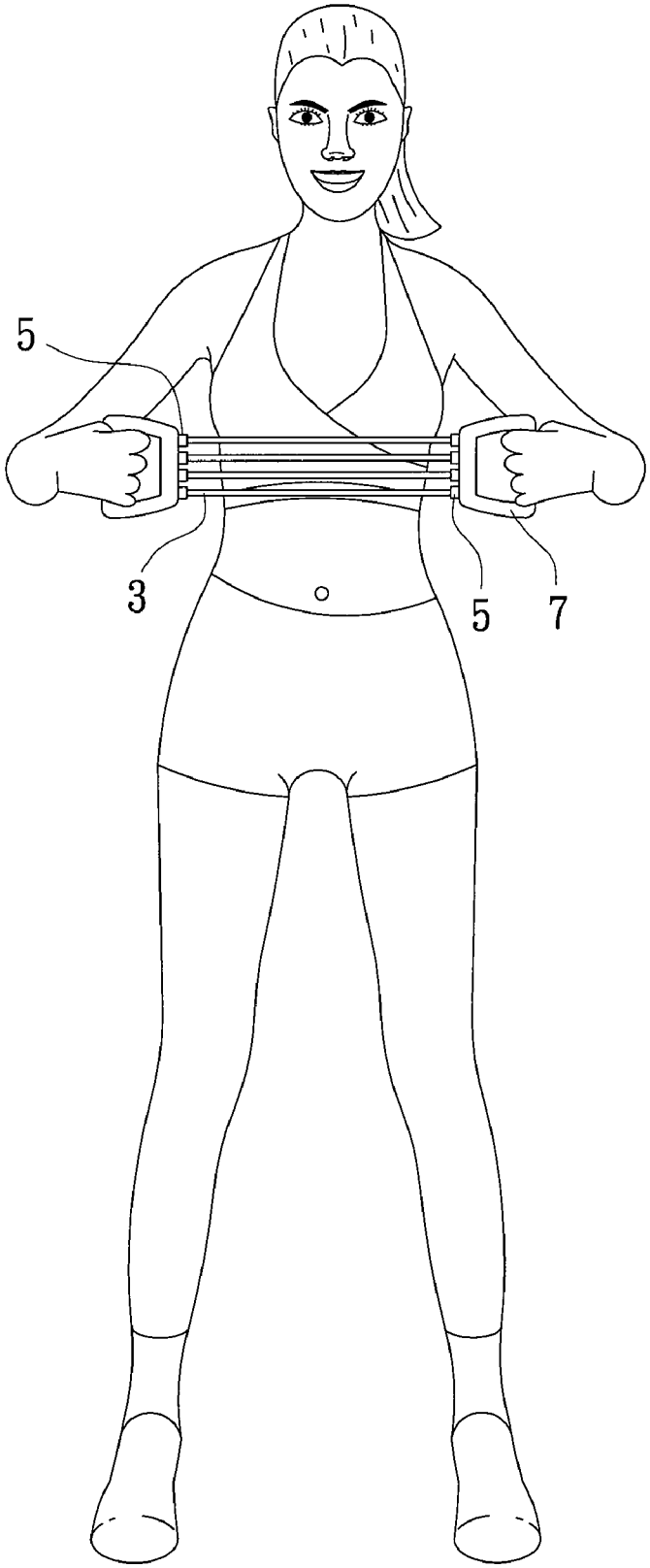
FIG. 9 is a view similar to FIG. 8, but illustrating another use of the fifth preferred embodiment.

Referring to FIGS. 8 and 9, a safety elastic rope according to the fifth preferred embodiment of the present invention is shown to be similar to the first preferred embodiment. However, in this embodiment, the safety elastic rope further comprises two handgrips 7 connected respectively to the fixing members 5. Through the presence of the handgrips 7, different forms of exercises may be performed. For example, the user may stretch both hands leftward and rightward, respectively and simultaneously, as shown in FIG. 9, or the user's hands may pull upwardly and respectively the handgrips 7 with the center of the outer tubular rope 3 being stepped on by one of the user's feet, as shown in FIG. 8. These exercises can train the muscles of the user's arms, chest, back, and other body parts.

Figure 10:
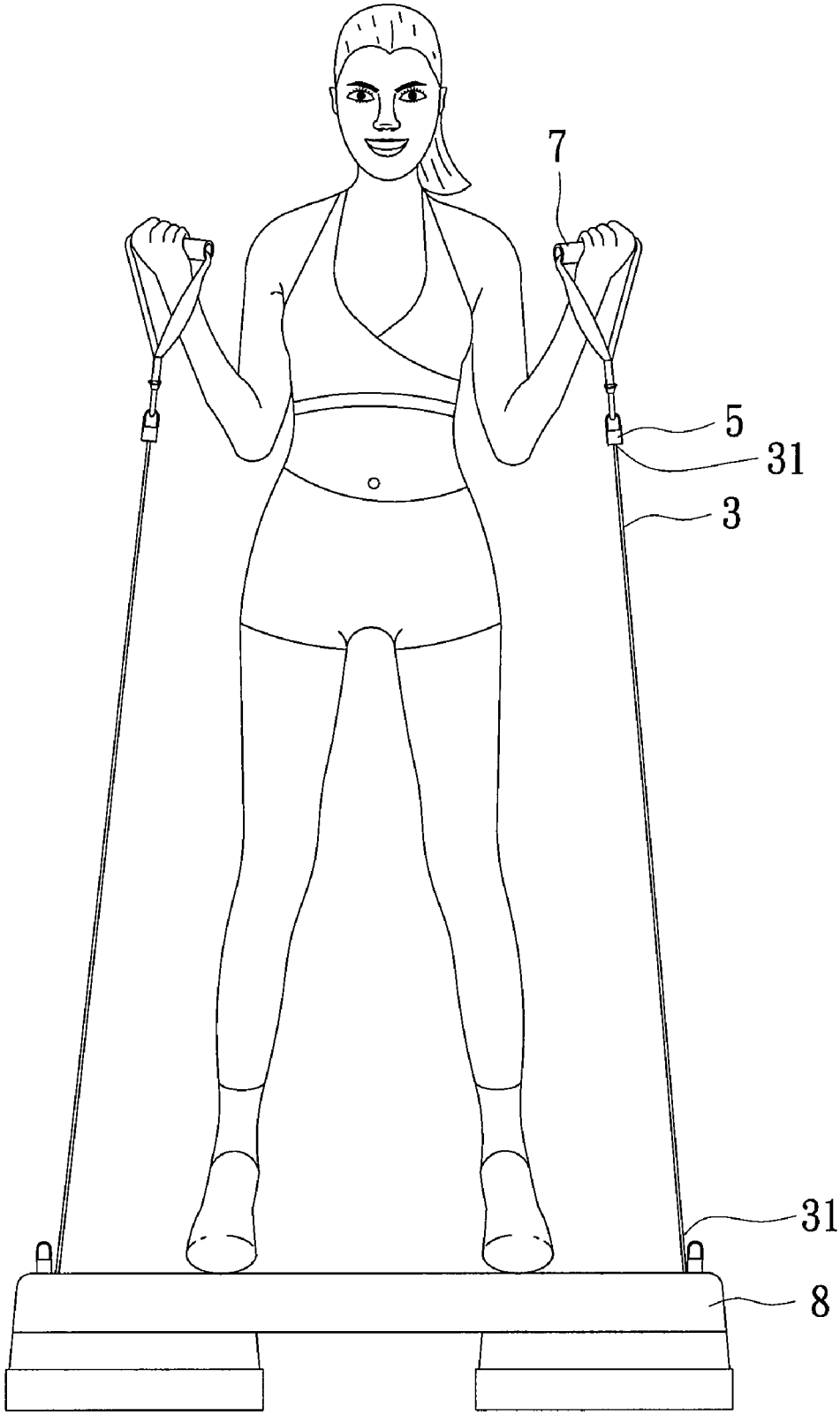
FIG. 10 is a fragmentary schematic view of a safety elastic rope according to the sixth preferred embodiment of the present invention in a state of use.

Referring to FIG. 10, a safety elastic rope according to the sixth preferred embodiment of the present invention is shown to be similar to the fifth preferred embodiment. However, in this embodiment, one of the first fixing ends 31 is connected to one of the fixing members 5, while the other first fixing end 31 is connected to, for example, a fixed support 8. The safety elastic rope of the sixth preferred embodiment may be used in combination with an elongated handle bar, an exercise ball, a sleeve ring, a chair, a roller, or other exercising devices so as to perform different exercises.

Figure 11:
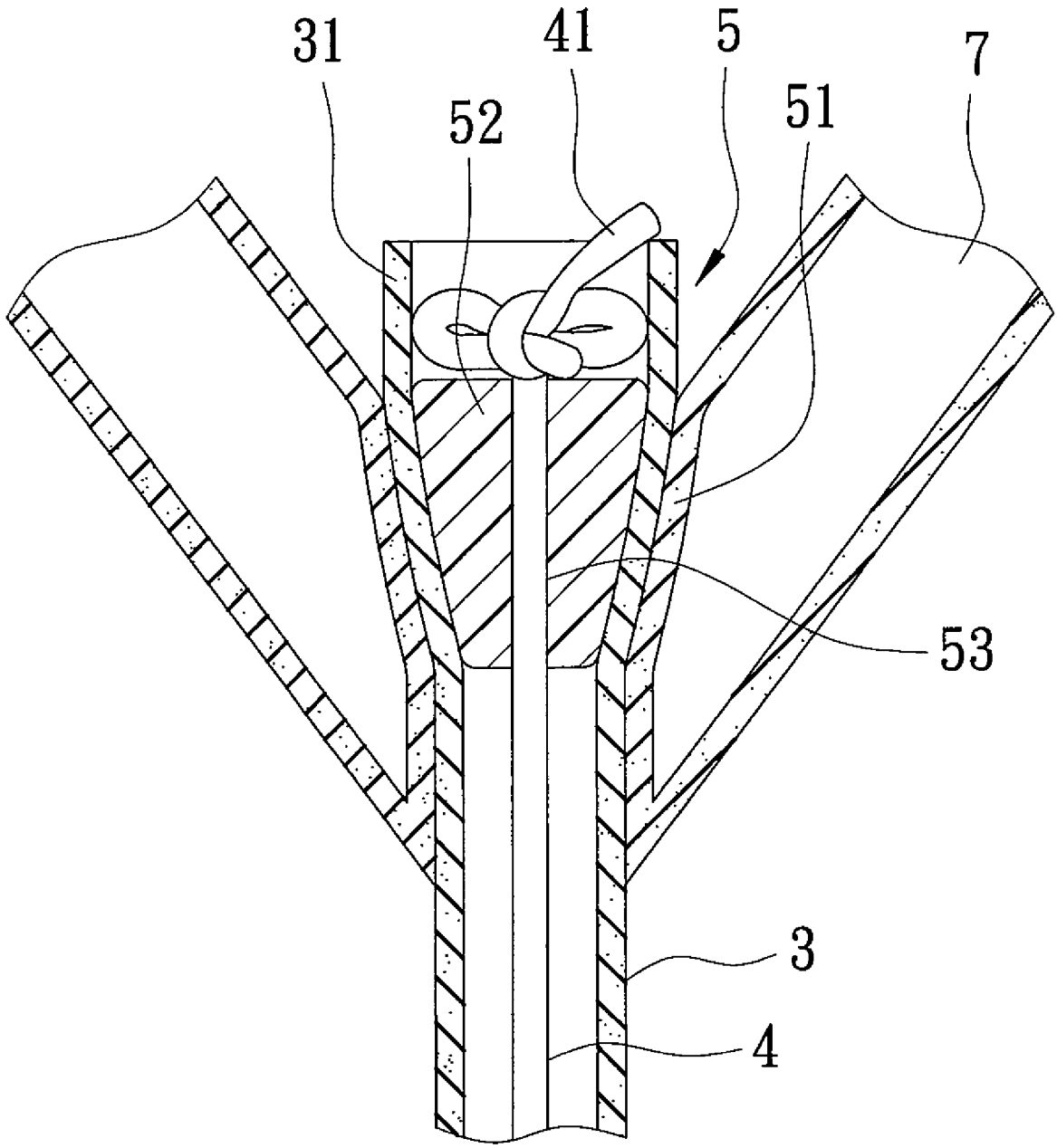
FIG. 11 is a fragmentary sectional view of a connection between a fixing member and a handgrip of a safety elastic rope according to the seventh preferred embodiment of the present invention.

Referring to FIG. 11, according to the seventh preferred embodiment of the present invention, the handgrip 7 is connected to a respective fixing member 5 by integrally forming the sleeve portion 51 with the handgrip 7. Preferably, the core portion 52 includes only one fixing hole 53, and is squeezed into the first fixing end 31. The second fixing end 41 extends through the fixing hole 53, and is tied into a knot, thereby fixing the second fixing ends 41 to the core portion 52. The sleeve and core portions 51, 52 press the first fixing end 31 therebetween.

Figure 12:
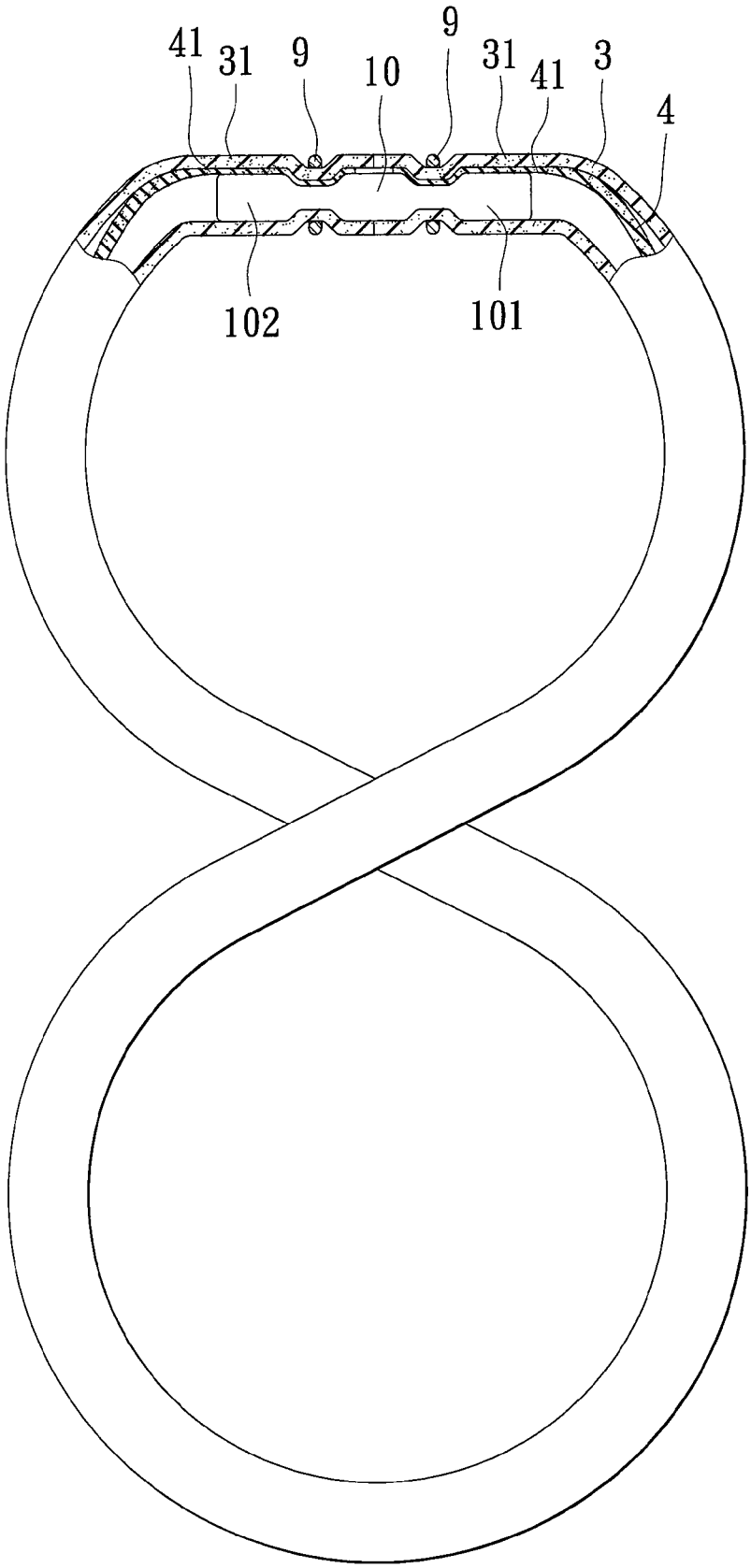
FIG. 12 is a partly sectional view of a safety elastic rope according to the eighth preferred embodiment of the present invention.

Referring to FIG. 12, according to the eighth preferred embodiment of the present invention, the safety elastic rope further comprises a coupling member 10 having a first coupling section 101 inserted into one of the first fixing ends 31 and one of the second fixing ends 41, and a second coupling section 102 inserted into the other first fixing end 31 and the other second fixing end 41. A first binder 9 is used to fix one of the first fixing ends 31 and one of the second fixing ends 41 to the first coupling section 101. A second binder 9 is used to fix the other first fixing end 31 and the other second fixing end 41 to the second coupling section 102.

Figure 13:
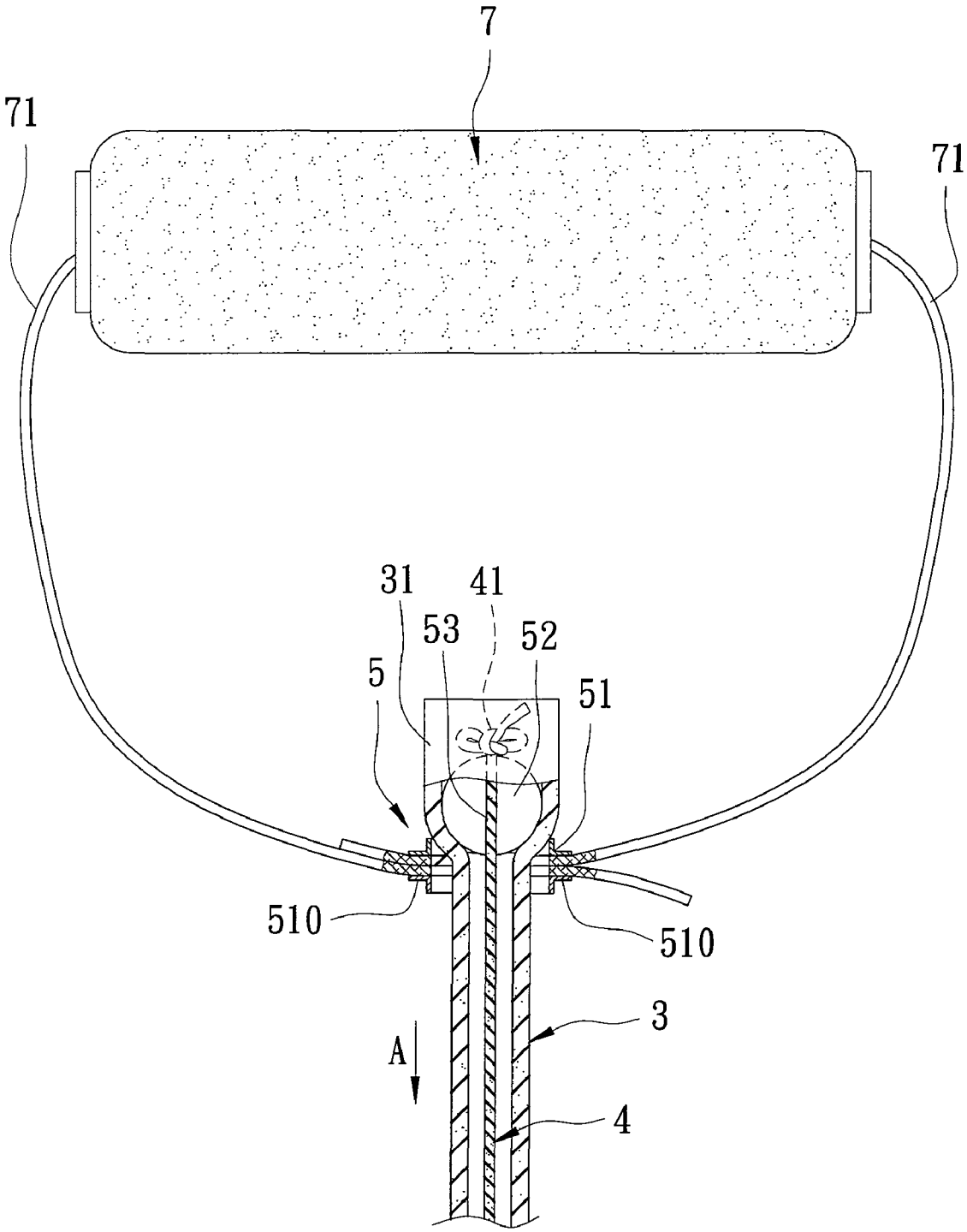
FIG. 13 is a fragmentary sectional view of a safety elastic rope according to the ninth preferred embodiment of the present invention.

Referring to FIG. 13, according to the ninth preferred embodiment of the present invention, the handgrip 7 has two strings 71. The core portion 52 is substantially ball-shaped, and has a fixing hole 53. The second fixing end 41 extends through the fixing hole 53, and is tied into a knot. The sleeve portion 51 has two oppositely projecting thin plate tubes 510. The strings 71 extend oppositely through the sleeve portion 51 and the two thin plate tubes 510 which are then squeezed to clamp the strings 71, thereby connecting the fixing member 5 to the handgrip 7. When the outer tubular rope 3 and the inner rope 4 are pulled in a direction (A), the core portion 52 presses the outer tubular rope 3 against a top end of the sleeve portion 51.

Figure 14:
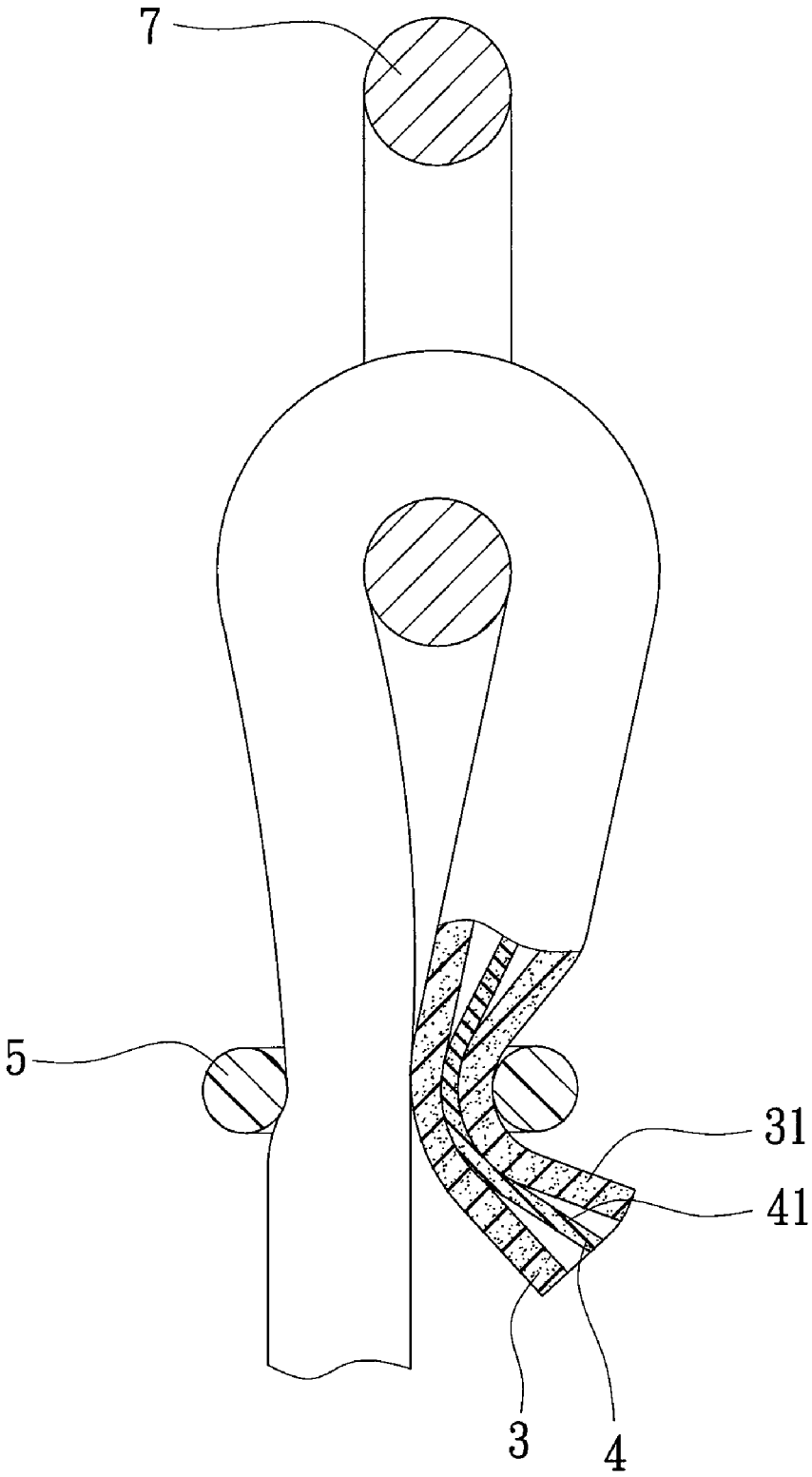
FIG. 14 is a fragmentary partly sectional view of a safety elastic rope according to the tenth preferred embodiment of the present invention.

Referring to FIG. 14, according to the tenth preferred embodiment of the present invention, the first fixing end 31 and the second fixing end 41 are looped around the handgrip 7. The fixing member 5 ties together the first and second fixing ends 31, 41.

Figure 15:
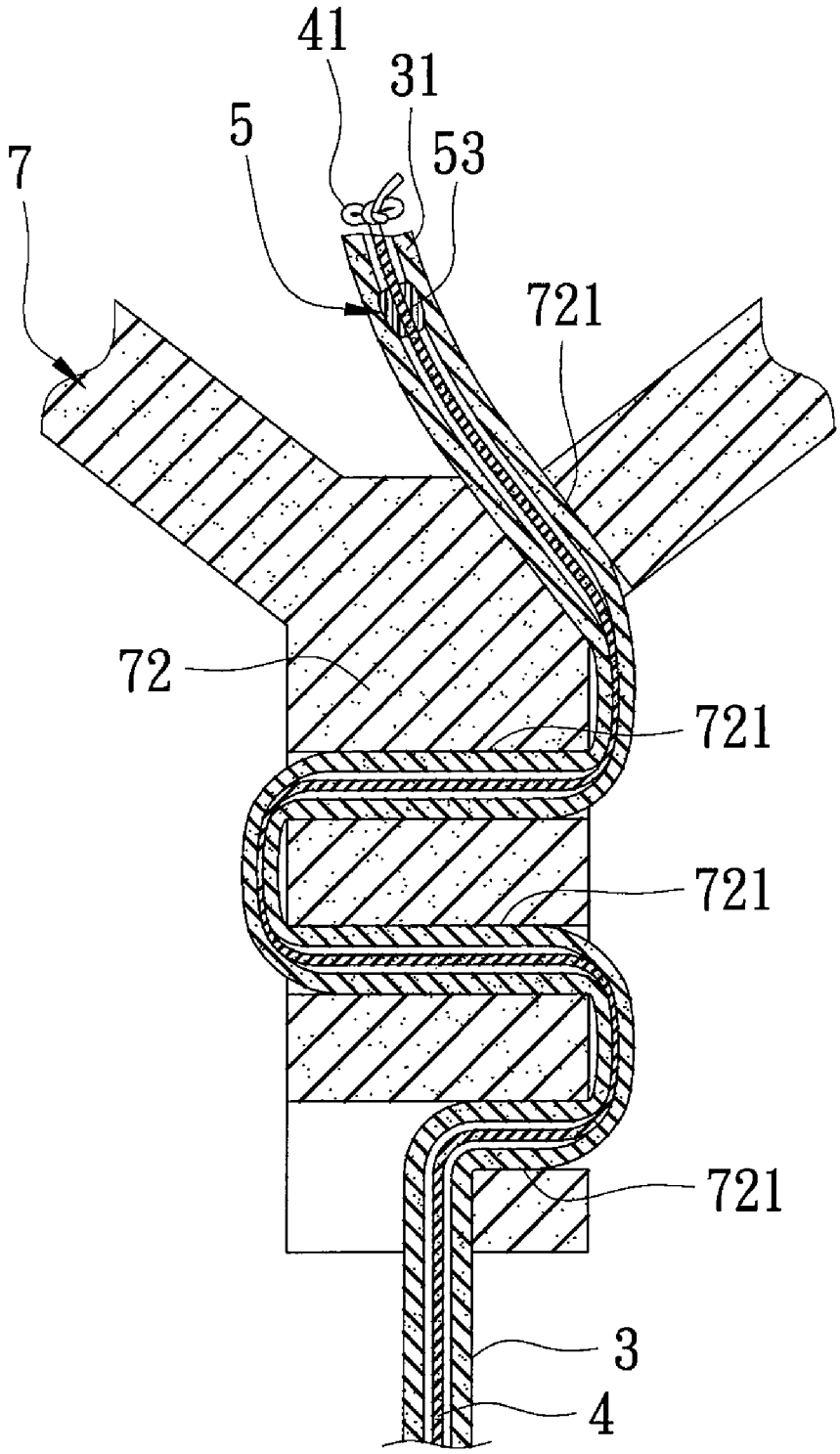
FIG. 15 is a fragmentary sectional view of a safety elastic rope according to the eleventh preferred embodiment of the present invention.

Referring to FIG. 15, according to the eleventh preferred embodiment of the present invention, the handgrip 7 has a connecting portion 72 formed with a plurality of through holes 721 that are transverse to a longitudinal direction of the outer tubular rope 3. The outer tubular rope 3 and the inner rope 4 extend through and turn between the through holes 721. The fixing member 5 squeezes into the first fixing end 31, and has a fixing hole 53. The second fixing end 41 extends through the fixing hole 53, and is tied into a knot. Hence, the fixing member 5 fixes together the first and second fixing ends 31, 41 externally of the connecting portion 72.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A safety elastic rope comprising:

an elastic outer tubular rope having two longitudinally opposite first fixing ends;

an elastic inner rope inserted into said outer tubular rope and having two longitudinally opposite second fixing ends; and two fixing members each of which connects one of said first ends to one of said second fixing ends;

wherein said inner rope is more elastic than said outer tubular rope, said second fixing ends being connected respectively to said first fixing ends; and wherein each of said fixing members includes a core portion, said outer tubular rope having a longitudinal through passage extending through said first fixing ends, said core portion having a cross section larger than that of said through passage, said core portion squeezing into and stretching transversely said one first fixing ends.

2. The safety elastic rope of claim 1, wherein said inner rope is made of a material selected from the group consisting of natural rubber, thermoplastic elastomer (TPE), and thermoplastic rubber (TPR).

3. The safety elastic rope of claim 1, wherein said core portion has a fixing hole that receives and holds fixedly one of said second fixing ends.

4. The safety elastic rope of claim 1, wherein each of said fixing members further includes a sleeve portion disposed around said core portion, one of said first fixing ends extending into said sleeve portion and being pressed between an inner surface of said sleeve portion and an outer surface of said core portion.

5. The safety elastic rope of claim 4, wherein said inner rope is tubular, said core portion further squeezing into one of said second fixing ends so that said one of said second fixing ends is pressed between said core portion and said one of said first fixing ends.

6. A safety elastic rope comprising;

an elastic outer tubular rope having two longitudinally opposite first fixing ends;

an elastic inner rope inserted into said outer tubular rope and having two longitudinally opposite second fixing ends; and a coupling member having a first coupling section inserted into one of said first fixing ends and one of said second fixing ends, and a second coupling section inserted into the other one of said first fixing ends and the other one of said second fixing ends;

wherein said inner rope is more elastic than said outer tubular rope, and has substantially the same length as said outer tubular rope, said second fixing ends being connected respectively to said first fixing ends.

7. The safety elastic rope of claim 1, further comprising two handgrips connected respectively to said fixing members.

8. The safety elastic rope of claim 4, further comprising two handgrips, each of which is formed integrally with said sleeve portion of one of said fixing members.

9. The safety elastic rope of claim 4, further comprising two handgrips, each of which includes a connecting string fixed to said sleeve portion of one of said fixing members.

10. The safety elastic rope of claim 1, further comprising two handgrips, each of which has a connecting portion provided with a plurality of through holes that are transverse to a longitudinal direction of said outer tubular rope, said outer tubular rope and said inner rope extending through and turning between said through holes, one of said fixing members fixing together a respective said first fixing end and a respective said second fixing end externally of said connecting portion.

11. The safety elastic rope of claim 1, further comprising two handgrips, one of said first fixing ends and a respective said second fixing end being looped around one of said handgrips and being tied together by one of said fixing members.

12. The safety elastic rope of claim 1, wherein said inner rope extends helically, and is made of a material selected from the group consisting of polypropylene (PP), polyethylene (PE), nylon, and polyvinyl chloride (PVC).

* * * * *